US006769751B1

(12) United States Patent
Harbison

(10) Patent No.: US 6,769,751 B1
(45) Date of Patent: Aug. 3, 2004

(54) CABINET STORAGE SHELF

(76) Inventor: Randall J. Harbison, 6607 Brodie La., Suite #623, Austin, TX (US) 78745

( * ) Notice: Subject to any disclaimer, the term of this patent is extended or adjusted under 35 U.S.C. 154(b) by 0 days.

(21) Appl. No.: 10/418,828

(22) Filed: Apr. 21, 2003

(51) Int. Cl.[7] ..... A47B 88/00
(52) U.S. Cl. ..... 312/311; 211/79; 211/80
(58) Field of Search ..... 312/330.1, 310, 312/311, 334.15, 334.27, 334.32; 211/151, 90.02, 79, 80; 220/23.89; 248/143; 472/44, 45, 46

(56) References Cited

U.S. PATENT DOCUMENTS

| | | | | | |
|---|---|---|---|---|---|
| 1,036,066 | A | * | 8/1912 | Bown | 312/198 |
| 1,170,580 | A | * | 2/1916 | Waldemarson | 248/128 |
| 3,259,748 | A | * | 7/1966 | Lammers | 250/507.1 |
| 4,296,984 | A | | 10/1981 | Lehman | 312/268 |
| 5,000,326 | A | | 3/1991 | Vaughn | 211/41 |
| 5,094,352 | A | | 3/1992 | Green, Sr. et al. | 211/186 |
| 5,474,374 | A | | 12/1995 | Sandvig | 312/274 |
| 5,676,262 | A | | 10/1997 | Justice et al. | 211/71 |
| 5,765,700 | A | | 6/1998 | Donne | 211/85.31 |
| 5,813,736 | A | | 9/1998 | Ballew | 312/249.9 |
| 5,964,665 | A | * | 10/1999 | Uemura | 472/45 |
| 6,131,746 | A | | 10/2000 | Huang | 211/41.11 |
| 6,227,387 | B1 | | 5/2001 | Rose | 211/85.29 |
| 6,293,414 | B1 | | 9/2001 | Stuart | 211/87.01 |
| 6,431,808 | B1 | * | 8/2002 | Lowrey et al. | 414/276 |

* cited by examiner

*Primary Examiner*—Peter M. Cuomo
*Assistant Examiner*—Stephen D'Adamo
(74) *Attorney, Agent, or Firm*—Christopher J. Whewell

(57) ABSTRACT

Provided herein is a storage shelf upon which various wares which are commonly stowed during times of their non-use, including kitchen utensils such as pots, pans, and other wares having handles intended to be grasped by their user. The present invention provides a sliding storage assembly which stores such wares with their handles in a stowed position, until the storage shelf of the invention is moved laterally, such as pulling towards the user, at which time the handles of the wares are automatically caused to be tilted upwards towards the user for ready grasping and added convenience over storage devices of like import contained in the prior art.

12 Claims, 8 Drawing Sheets

CABINET STORAGE SHELF

FIELD OF THE INVENTION

This invention relates to storage means for storing utensils, including without limitation kitchen utensils such as pots, pans, and the like. More particularly, it relates to a slidable platform upon which various utensils may be stored, wherein the platform may be disposed within a cabinet, and slid out from the cabinet on track means when accessed. The storage means according to the invention confer increased convenience to a person desirous of retrieving a utensil.

BACKGROUND

Various storage means for conveniently storing a variety of implements, utensils, and wares have been contrived over the years. The products of the labors of a few workers in the prior art are embodied in several U.S. Patent documents, now cited, which are fully incorporated herein by reference thereto.

U.S. Pat. No. 4,296,984 provides a modular preassembled article storage and transport conveyor apparatus which comprises: a) a substantially rigid unitized support housing having at least one access opening in a side thereof; b) a pair of endless conveyor chains forming arcuate curved portions at opposite ends in offset relationship and disposed in laterally spaced parallel planes, wherein each chain has multiple articulated links, plural spaced article storage and transport trays suspended at diagonally opposite corners in level relationship from the chains. The trays are adapted to pass in succession adjacent to the at least one access opening of the housing, fixed guide track means for the chains on the housing and defining continuous substantially uninterrupted guidance paths for the endless chains along their entire movement paths. The fixed guide track means include arcuate support and guide portions for the arcuate curved portions of the chains. There is a power drive means for the chains on the housing including a pair of sprocket gears respectively in operative engagement with the exteriors of the pair of chains away from the arcuate support and guide portions and at a fixed point on the arcuate curved portion of each chain that face each other.

U.S. Pat. No. 5,000,326 describes a rack positionable in a substantially-vertical orientation and in a substantially-horizontal orientation for storing and securely holding within the rack at an optimum storage angle when the rack is positioned in either the substantially vertical orientation or the substantially horizontal orientation a plurality of cooking container lids. The rack includes: a) support frame means for positioning the rack alternatively in the substantially vertical orientation or in the substantially horizontal orientation; and b) a plurality of adjustable lid-holding module means removably fitted into the support frame means for receiving the plurality of lids. Each of the module means is adjustable to support each of the lids substantially within the support frame means at the optimum storage angle in spaced, non-interfering parallel relationship with adjacent lids when the rack is in the substantially vertical and in the substantially horizontal orientation.

U.S. Pat. No. 5,094,352 provides a portable rack for holding pots, pans, cookie sheets and lids for the pots and pans which comprises: a) two pair of main frame leg members with each pair of leg members sloping inwardly toward each other, and wherein the leg members have flat outside and inside attaching surfaces; b) caster wheel members secured to the bottom of each leg member, c) peg board members secured to an outside attaching surface of each pair of inwardly sloping leg members; d) a top closure member positioned at the top of the pairs of inwardly sloping leg members; e) peripherally extending support members for supporting the top closure member; f) a plurality of inner shelf members extending between the pairs of inwardly sloping leg members; and g) a means for defining a retaining slot for cookie sheets and lids for the pots and pans located between the sloping leg members. The means for defining the retaining slot includes a portion of an inside surface of one of the peg board members, a portion of one of the shelf members and an additional retaining strip secured to an inside attaching surface of each of a pair of the leg members at a location spaced from the one of the shelf members.

U.S. Pat. No. 5,474,374 teaches a sliding tray assembly for mounting in a kitchen cabinet or the like. The edges of the tray panel are received in guide channels, and a drawbar is attached to the cabinet door to automatically slide the tray in and out. The forward end of the panel is radiused off at one corner to clear the inside of the door, and the bracket for mounting the rearward end of the drawbar to the panel is configured to allow the panel to be inverted for left- or right-hand installations. The bracket also provides a back-stop for retaining articles on the tray panel.

U.S. Pat. No. 5,676,262 discloses a holder for storing and dispensing various sizes of bakeware. The holder includes a rear wall joined at opposite edges by forwardly projecting side walls. The side walls extend parallel to one another and each have perpendicular securing tabs at their bottom edge. The securing tabs are to be mounted to a flat surface, such as a kitchen shelf or cabinet, so that the bakeware may be supported in a vertical arrangement by the holder side walls with one edge of the bakeware resting on the flat surface.

U.S. Pat. No. 5,765,700 sets forth a support rack for holding gourmet pots and pans which comprises: a) a circular support base; b) a plurality of lower, inwardly curved supporting legs extending from the circular support to a plurality of outwardly curved upper supporting arms in which the arms extend to an upper circular frame member; c) a plurality of hook means extending from the upper circular frame member for supporting a plurality of gourmet pots and pans; d) a median section between the lower legs and the upper arms having at least one support ring; e) at least one hook means extending from the median section for supporting gourmet pots and pans. The supporting legs and arms provide a means whereby a see-through display effect is created whereby all of the gourmet pots and pans are effectively shown. The median section is of smaller diameter than the supporting base to provide enhanced stability for the overall unit. The upper circular frame member is of larger diameter than the median section to allow the gourmet pots and pans to be effectively displayed, wherein the components are comprised of metal or other long-life material.

U.S. Pat. No. 5,813,736 provides a cabinet storage device comprising: a) a base slidingly attached to a cabinet so that the base is movable outwardly from a storage position to an extended position; b) a front having an upper end and lower end, wherein the lower end is secured to the base and extends upwardly therefrom to the upper end; c) a back having an upper end and a lower end, wherein the lower end is secured to the base and extends upwardly therefrom to the upper end; d) one or more generally vertical panels connected to the front and the back, so the generally vertical panels move along with the base from the storage position to the extended position and wherein each panel includes means for attaching items to the panel so easy access to the attaching means is provided when the base is in an extended position. There is also at least one support means to provide additional support for the base when the base is extended outwardly from the cabinet, wherein the support means comprises a retractable arm having two ends, wherein one end is pivotally connected to the cabinet storage device so the arm extends downwardly from the base to the second end when the arm is in the extended position, wherein the arm pivots upwardly to a storage position when the base is in the storage position.

U.S. Pat. No. 6,131,746 discloses a pot lid storage trough comprising: a) a bottom member having an elongated configuration with a surface having two lengthwise parallel grooves therein, with the first end of each groove being open and the second end of each groove being closed, the bottom member also having a stop member formed beside the open end of each groove and a sloped face portion adjacent to each of the grooves; b) a case member having an elongated configuration with two lengthwise parallel storing cavities, the case member having a bottom wall and opposite side walls; c) a first pair of parallel rails extending downwardly from the bottom wall of the case member and extending lengthwise along the case member, each rail having a key thereon; and d) a second pair of parallel rails extending outwardly from one of the opposite side walls of the case member, and extending lengthwise along the case member, each rail having a key thereon. In use, one pair of the first and second pairs of rails slidably engages the grooves in the bottom member to thereby slidably attach the case member to the bottom member such that the case member may be supported by the bottom wall having the first pair of rails, or by the side wall having the second pair of parallel rails.

U.S. Pat. No. 6,227,387 describes a utensil supporting apparatus with sound attenuating means, comprising: a) a base member having a surface, the base member mountable on a structure; b) a plurality of fasteners mounted on the base member, the fasteners for holding utensils in a pendant mode; and c) a sound attenuating means depending from the base member surface, the sound attenuating means positioned between each of the utensils.

U.S. Pat. No. 6,293,414 teaches a wall-mounted shelving system comprising: a) a plurality of elongated standards secured to a wall, wherein each the elongated standard has a vertical axis, wherein the standards contain a plurality of slots; b) a plurality of shelf brackets removably connected with the standards via the slots; c) one or more shelves with a plurality of ends, wherein the shelves are supported by the shelf brackets; and d) a plurality of side panels, wherein each the side panel has a means for removable attachment of the side panel to the ends of the shelves, so as to easily and removably enclose the shelves at the ends.

However, of all of the storage means of the prior art known, none comprises a slidable platform which enables the compact storage of bulky utensils that comprise a handle means as a portion of their construction, while simultaneously providing easy access in retrieval of such utensils when desired.

SUMMARY OF THE INVENTION

The present invention provides a storage means for storing various implements which comprises: a substantially planar framework comprising an interior volume, a top surface, and a bottom surface. The framework comprises a plurality of frame members each having an outer surface, and a portion of the outer surface of each of said frame members is disposed within said interior volume, The frame members collectively define the perimeter of the framework. There is a linear support axle disposed within the interior volume of the framework, which support axle comprises a first end portion and a second end portion. The first end portion of the linear support axle is connected to one of the frame members of the planar framework at a point disposed within the interior volume, and the second end portion of the linear support axle is connected to one of the frame members of the planar framework at a point disposed within the interior volume. There is at least one contact roller disposed about the linear support axle. There are a plurality of cradle support arms affixed to the framework, wherein the cradle support arms include a pivot point boss. The invention further comprises at least one tiltable cradle, which comprises a circumferential exterior surface and an axis point. The axis point of the tiltable cradle is pivotally disposed about the pivot point boss, and the circumferential exterior surface is in contact with the at least one contact roller.

DETAILED DESCRIPTION

Figure 1:
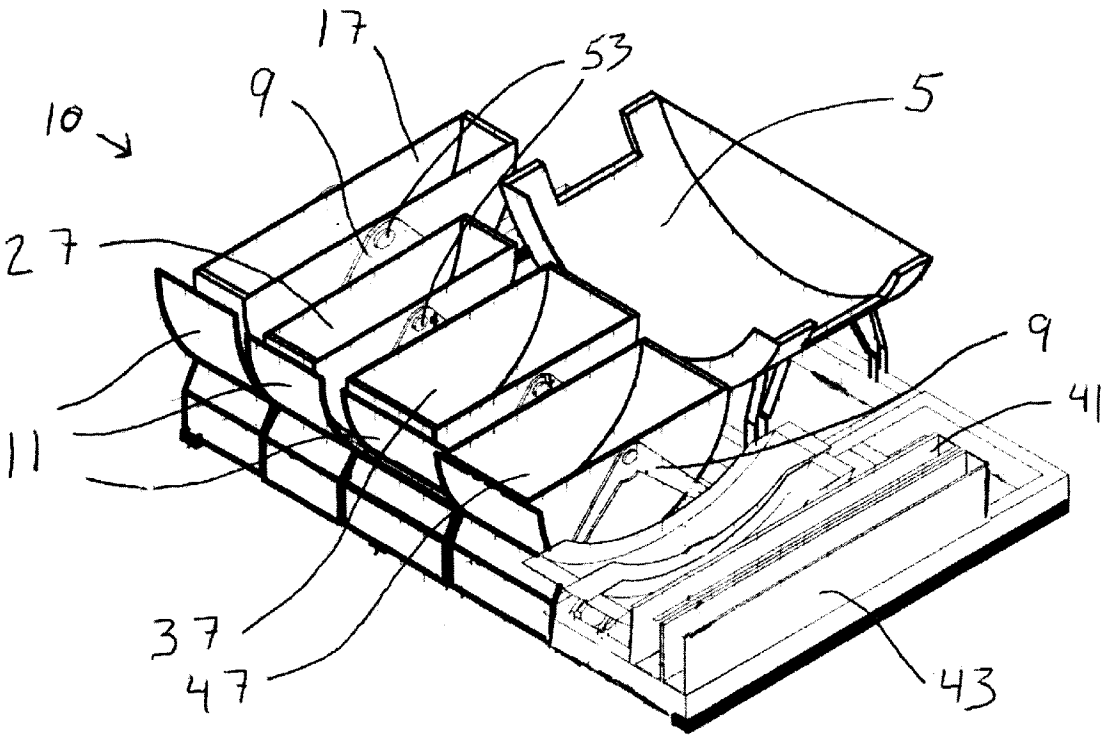
FIG. 1 is a perspective view of a storage shelf according to the present invention.

Referring to the drawings and initially to FIG. 1 there is shown a perspective view of a storage shelf 10 according to the present invention in its assembled form. There are tiltable cradles 17, 27, 37, and 47 into which an item to be stored is to be contained by the storage shelf. The tiltable cradles include a circumferential exterior surface, that is to say, their outer surface has a circular contour and the reason for this essential feature will become apparent from other descriptions herein. The tiltable cradles are in one preferred embodiment configured as semi-circular shells, or half-shells. The tiltable cradles thus each include an interior volume into which an item to be stored, such as a pot or pan, may be housed. There are shields 11 disposed at the front portion of the storage shelf according to one preferred form of the invention, and their function is protective to the tiltable cradles to prevent unwanted impacts or percussions from damaging the tiltable cradles during the course of normal usage of a shelf according to the invention. There are also shown cradle support arms 9, each having a pivot point boss 53. The tiltable cradles 17, 27, 37, and 47 are mounted to the support arms 9 at a point approximately corresponding to the center of curvature of the outer circumferential exterior surface of the tiltable cradles, to render the tiltable cradle element to be pivotally disposed about the pivot point boss. The present invention also includes miscellaneous provisions for storing various wares which are desired to be stowed, such as the stationary cradle 5 which is contoured to receive an object having a circular outer dimension, such as a large pot or pan, and storage trays 41 and 43.

Figure 2:
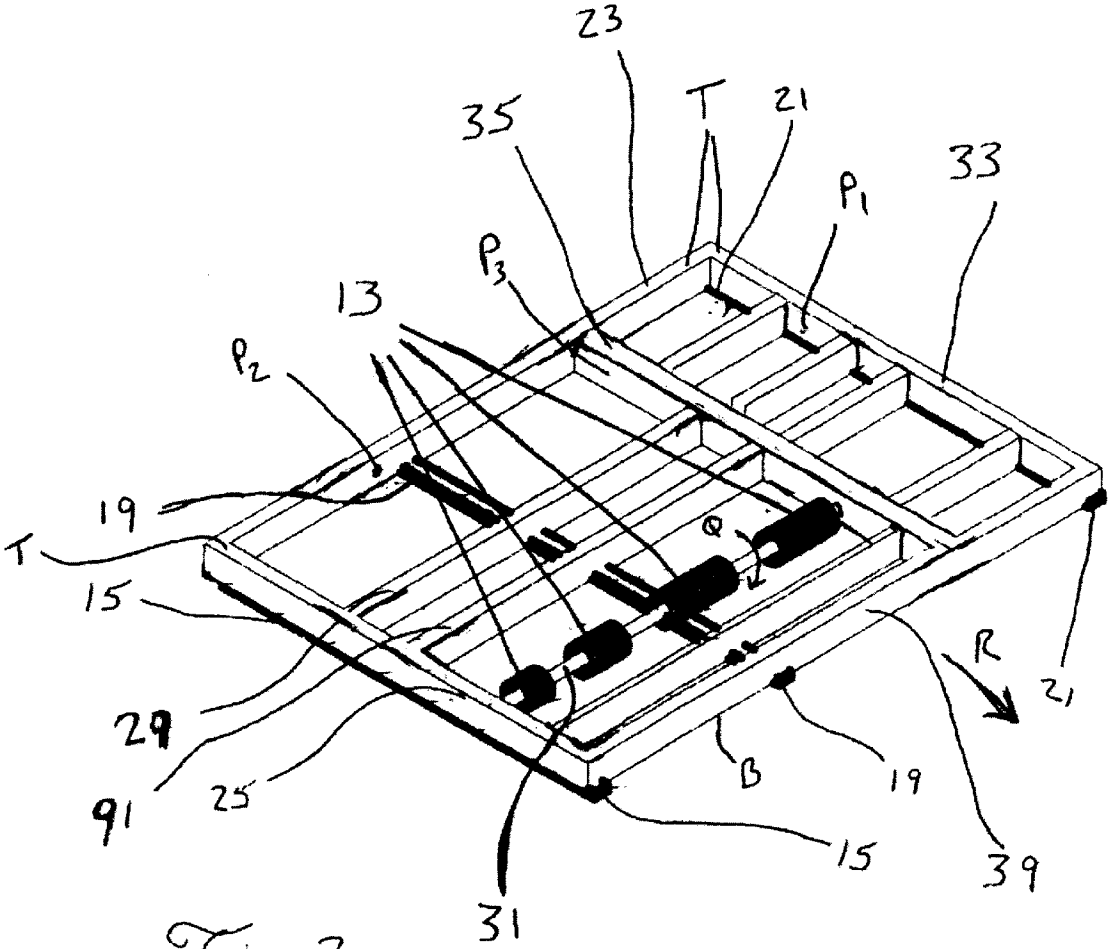
FIG. 2 is a perspective view of the framework of a storage shelf according to the present invention clearly showing the contact roller(s) elements.

In FIG. 2 is shown a perspective view of the framework of a storage shelf according to the present invention. In FIG. 2 the substantially planar framework of a storage shelf according to the invention is depicted. There are a plurality of frame members which collectively comprise the substantially planar framework. These include the first frame member 23, second frame member 25, third frame member 33, and the fourth frame member 39. The designations "first frame member" and "second frame member" etc. are so named for convenience in use in this specification, and the invention shall not be construed to be limited in any manner by virtue of the use of such nomenclature. There is also a frame support 35. The various aforesaid frame members are preferably square or rectangular in cross section, but the present invention also contemplates frame members having other cross sections, including without limitation, oval, circular, hexagonal, pentagonal, or any other geometry with the main proviso being that they should be of sufficient strength to impart structural strength to the finished construct for supporting the weight of the items desired to be stowed on a shelf according to the invention. According to one preferred form of the invention, the frame members are made of a wood, such as pine, poplar, oak, cherry, particle board, or any wood generally recognized by cabinetmakers as being suitable for such constructions. The present invention also contemplates the use of metallic frame members such as aluminum or steel, and those made from reinforced composite materials, such as fiberglass and graphite composites as well as other composite materials recognized by those skilled in construction. The frame members each inherently comprise an outer surface, a portion of which outer surface is inherently disposed within the interior volume of the framework, as defined below.

In the finished framework construction, the framework members each have a top surface T and a bottom surface B which cannot be seen completely in FIG. 2, however, the bottom surface appears the same as the top surface when the frame members are of a square or rectangular cross section.

The frame members all collectively define an interior volume, which volume is defined for purposes of this specification and the appended claims as quite simply the volume residing within the framework. This volume is bounded by a first plane contacting the top surface of a frame member at three points functioning as a ceiling, a second plane contacting the bottom surface of a frame member at three points functioning as a floor, and bounded by the frame members themselves, functioning collectively as a wall. In one preferred form of the invention, the first and second planes are parallel to one another, as in the case of the construction shown in FIG. 2, and the inner volume therein is shaped as a tetragonal solid. Actually, owing to the presence of other frame members, there are several regions within the inner volume, which are separated from one another by the various supports such as 29, 91, 35 and others not labeled. For further clarity, in FIG. 2 the point $P_1$ is a point on a frame member which is disposed within the interior volume, as $P_2$ and $P_3$ are also points on a frame member which are disposed at a point within the interior volume.

FIG. 2 also shows that there is a linear support axle 31 disposed within the interior volume of the framework. The linear support axle 31 comprises a first end portion and a second end portion. The first end portion of the linear support axle is connected to one of the frame members of the planar framework at a point disposed within the interior volume, and the second end portion of the linear support axle is also connected to one of the frame members of the planar framework at a point disposed within the interior volume. The linear support axle includes at least one contact roller 13 disposed about the linear support axle 31. According to a preferred form of the invention, there are a plurality of contact rollers 13 having a cylindrical outer contour disposed about the linear support axle 31. The purpose of the contact rollers is to provide motion to the tiltable cradles such as 17, 27, 37, and 47. This is accomplished by virtue of the contact rollers having sufficient diameter that their outer surface resides outside of the interior volume of the framework. Specifically, in the event that a framework according to the invention is disposed atop a planar support surface, such as the flat bottom of a cabinet, is moved in a direction of the arrow labeled R in FIG. 2, the contact rollers 13 are caused to be rotated in a direction shown by the arrow labeled Q by virtue of the contact of the contact rollers 13 with the planar support surface causing them to rotate. The present invention includes the embodiment which includes the fitting of various bearings means known to those skilled in the art between the linear support axle 31 and the inner bore of the contact rollers 13. The present invention also includes the embodiment which provides for the contact rollers 13 being in fixed position with respect to their disposal about the linear support axle 31, and the first and second end portions of the linear support axle being fitted with any one of various bearing means known to those skilled in the art at their points of connection to a frame member, to thus provide the linear support axle 31 with rotational capability. In any event, the contact rollers 13 are disposed so that they are also in contact with the circumferential exterior surface of a tiltable cradle element of the present invention, such as 17, 27, 37, and 47. By virtue of the contact of the contact rollers 13 being in contact with the planar support surface as described above, the contact rollers are caused to be rotated in the direction Q when a shelf according to the present invention is pulled forward in the direction of R, thus causing a tiltable cradle whose circumferential exterior surface is in contact with a contact roller to be tilted simultaneously with the pulling out of the shelf construction. Such tilting provides convenience in access to a person using a shelf according to the invention, in the retrieval of a stored item.

For convenience, a shelf according to one preferred form of the invention is affixed to a cabinet in which it is housed by a track means, such as those employed commonly for drawer assemblies, with various track means being known in the art. The present invention is usable with all track means known in the art. An essential feature of track means which permit the slidable motion of one article with respect to another, is that track means will comprise generally two cooperating complementary counterparts. For example, one popular combination includes a track mounted to a cabinet, with drawers having wheels affixed to the drawers, which wheels are mounted on bearings to enable them to rotate. In use, the drawer is located into position so that the wheels are disposed within the track, and the drawer is enabled to slide in and out with relative ease. Another popular assemble is where the cabinet is fitted with a track, and the drawer is fitted with a track of smaller dimension, which smaller track slides within the inner track during normal motion of the drawer. Many other configurations are known. However, they all share in that one of the cooperating complementary counterparts of the moving assembly is attached to the frame or cabinet, with the other complementary counterpart being attached to the object being slidably mounted therein or thereon, such as a drawer or sliding door. According to one preferred form of the present invention, the bottom surface of the framework is provided with one of the complementary counterparts of a sliding assembly which enables the construction to be slid in and out of a cabinet in which it is stowed. FIG. 2 shows conventional track means 15, 19, and 21 affixed to the bottom surfaces of various frame members.

Figure 3:
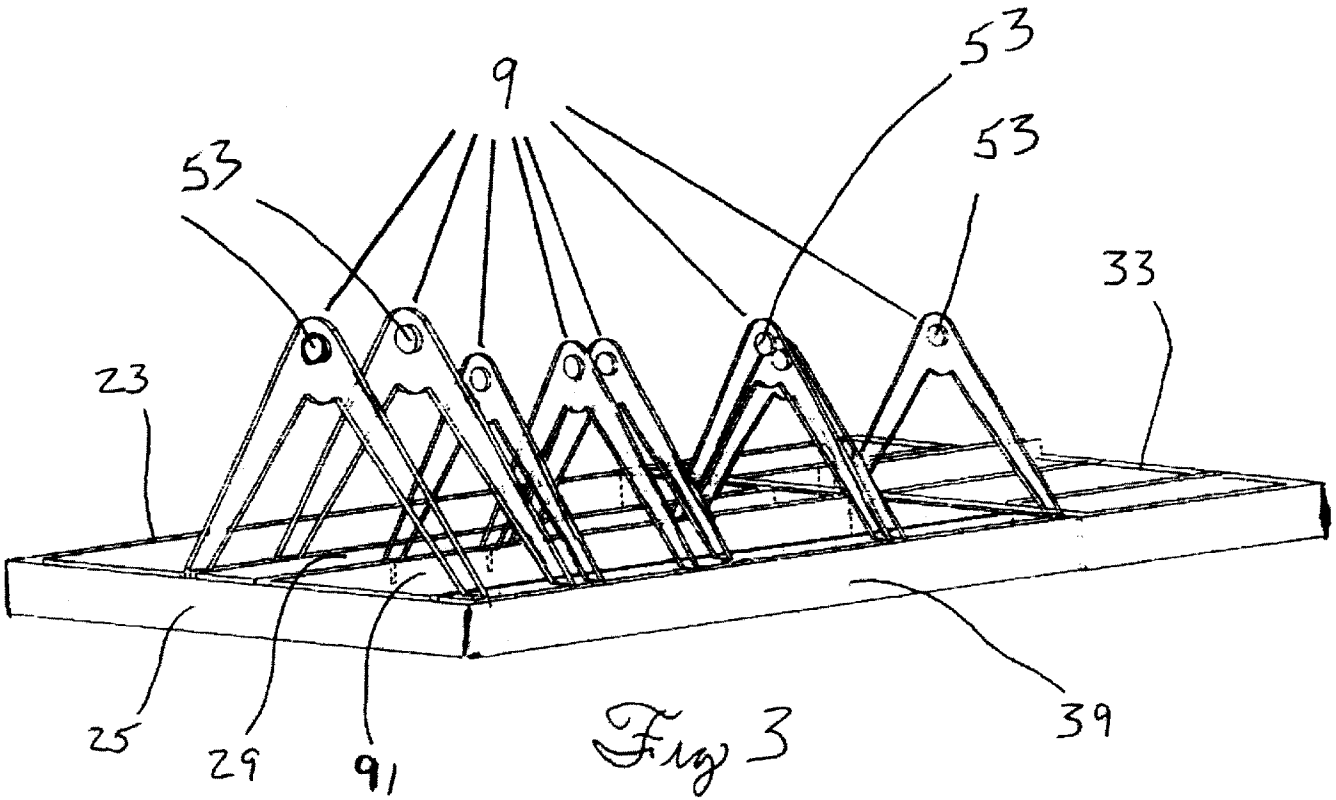
FIG. 3 is a perspective view of the framework of a storage shelf according to the present invention clearly showing the cradle support arm(s) elements.

FIG. 3 is a perspective view of the framework of a storage shelf according to a preferred form of the present invention clearly showing the cradle support arms 9, having pivot point bosses 53. While the cradle support arms 9 are shown in what might be best described as an upside-down "V" configuration, this preferred embodiment should not be construed as delimitive of the various other possible configurations for the cradle support arms 9 which will become apparent to one of ordinary skill upon reading this specification. The cradle support arms 9 function to support the tiltable cradles at the pivot point bosses 53, which are the points of attachment of the tiltable cradles. Each cradle support arm includes one pivot point boss 53, and according to a preferred form of the invention, there are two cradle support arms for each tiltable cradle, with one cradle support arm being disposed on each side of the tiltable cradle, with a pivotable connection being disposed between the cradle support arms and the tiltable cradles. The pivotable connection may be accomplished by means of bearings. According to an alternate form of the invention, the pivot point boss is a circular hole disposed in the cradle support arm, and a corresponding circular protrusion is cast in to the tiltable cradles at their axes of intended rotation about the cradle support arms 9, with the circular protrusion on the tiltable cradles being slightly smaller than the diameter of the hole in the cradle support arms 9 at 53, the boss. The present invention includes all means for providing a pivotable connection between the tiltable cradles and the cradle support arms, as such means are known to those skilled in the art. Also shown in FIG. 3 are the first frame member 23, second frame member 25, third frame member 33, fourth frame member 39, and inner supports 29 and 91.

Figure 4:
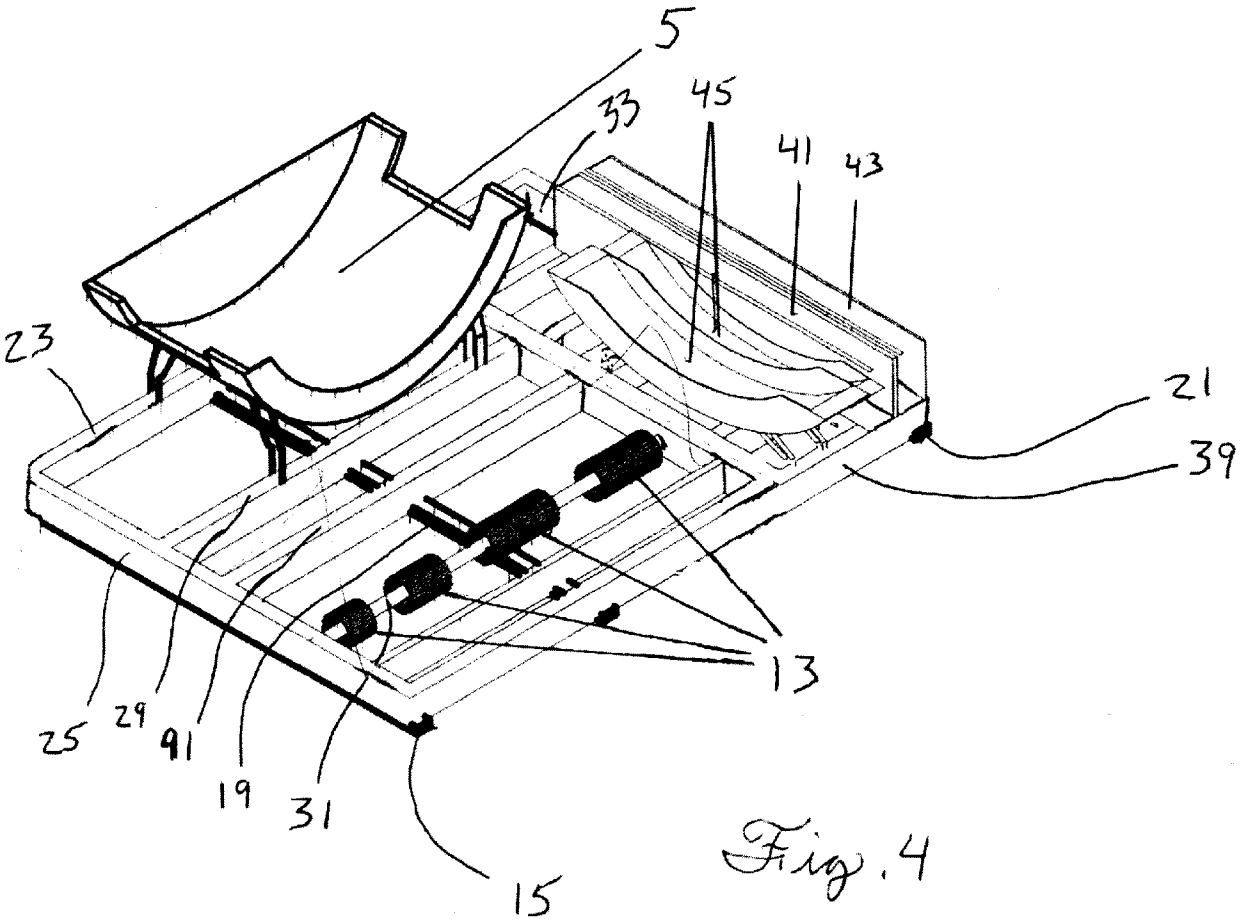
FIG. 4 is a perspective view of the framework of a storage shelf according to the present invention clearly showing the contact roller(s) elements and various storage features.

FIG. 4 provides a perspective view of the framework of a storage shelf according to the present invention clearly showing the contact roller(s) elements and various storage features. In this FIG. 4 are shown the first frame member 23, second frame member 25, third frame member 33, fourth frame member 39, and inner supports 29 and 91. Also shown are the track means 15, 29, and 21, as well as the stationary cradles 5 and 45, and storage trays 41 and 43. The respective positions of the linear support axle 31 and contact rollers 13 are also shown. The contact rollers 13 may be comprised of any material sufficient to transmit the motive energy from the sliding of a construction according to the invention to the outer circumferential edges of the tiltable cradle means. Thus, the contact rollers 13 may comprise a polymeric substance, such as a rubber, thermoplastic, polyurethane, etc. According to one preferred form of the invention, the contact rollers 13 are made from rigid polyurethane foam.

Figure 5:
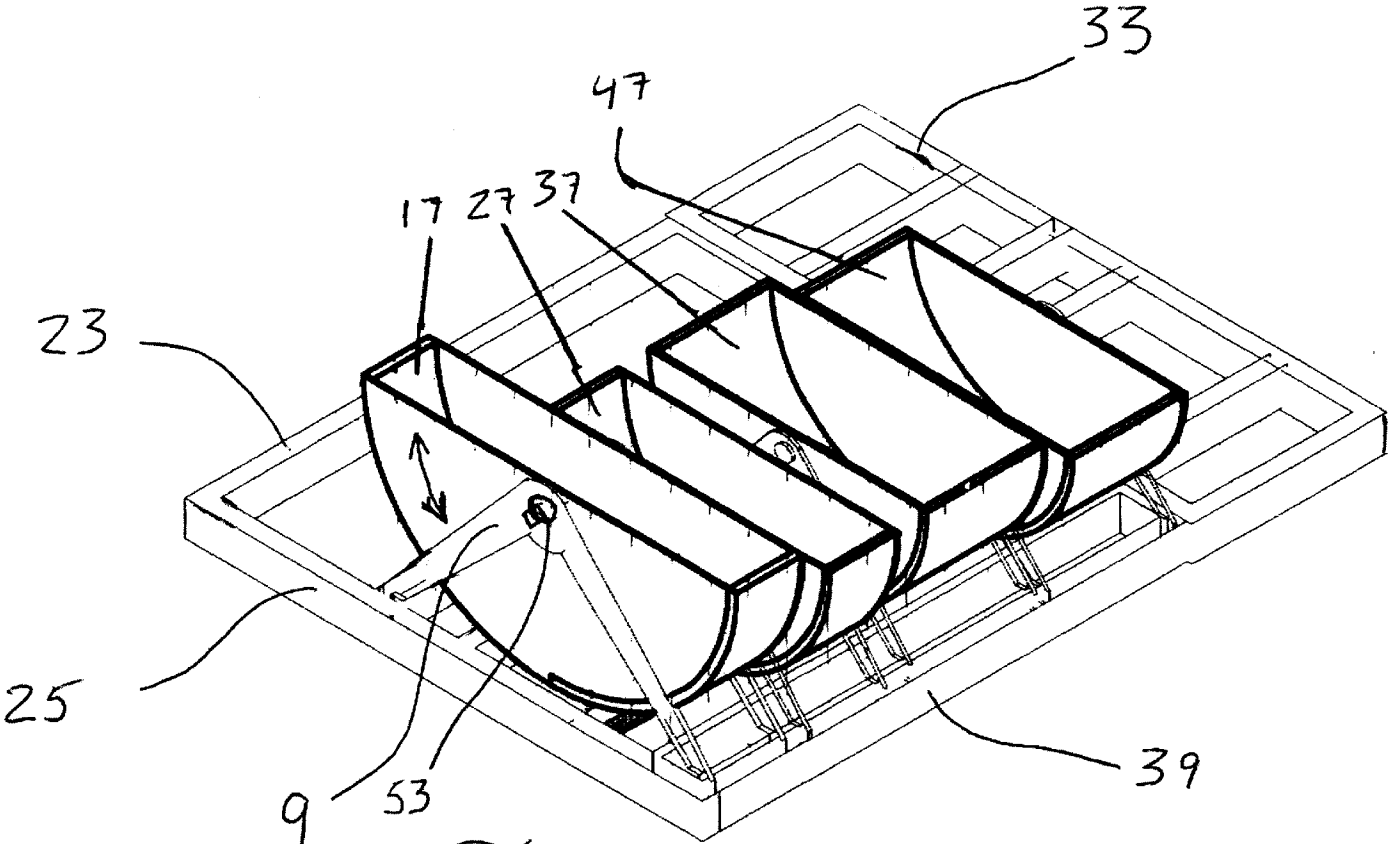
FIG. 5 is a perspective view of the framework of a storage shelf according to the present invention clearly showing the tiltable cradle(s) elements.

FIG. 5 is a perspective view of the framework of a storage shelf according to the present invention clearly showing the tiltable cradle(s) elements 17, 27, 37, and 47 pivotally disposed with respect to the cradle support arms 9 in which they are rotably mounted at the pivot point boss 53 in the direction of the arrow. Also shown are the first frame member 23, second frame member 25, third frame member 33, and fourth frame member 39. The cradle support arms 9 are constructed of thick gauge wire in one form of the invention. According to a preferred form of the invention, the various elements of the invention are connected to one another using conventional fasteners, including rivets, screws, nuts and bolts, dowel pins, or welds. Brackets and fixtures may be used as aids in construction, as the use of such are well known in the art.

Figure 6:
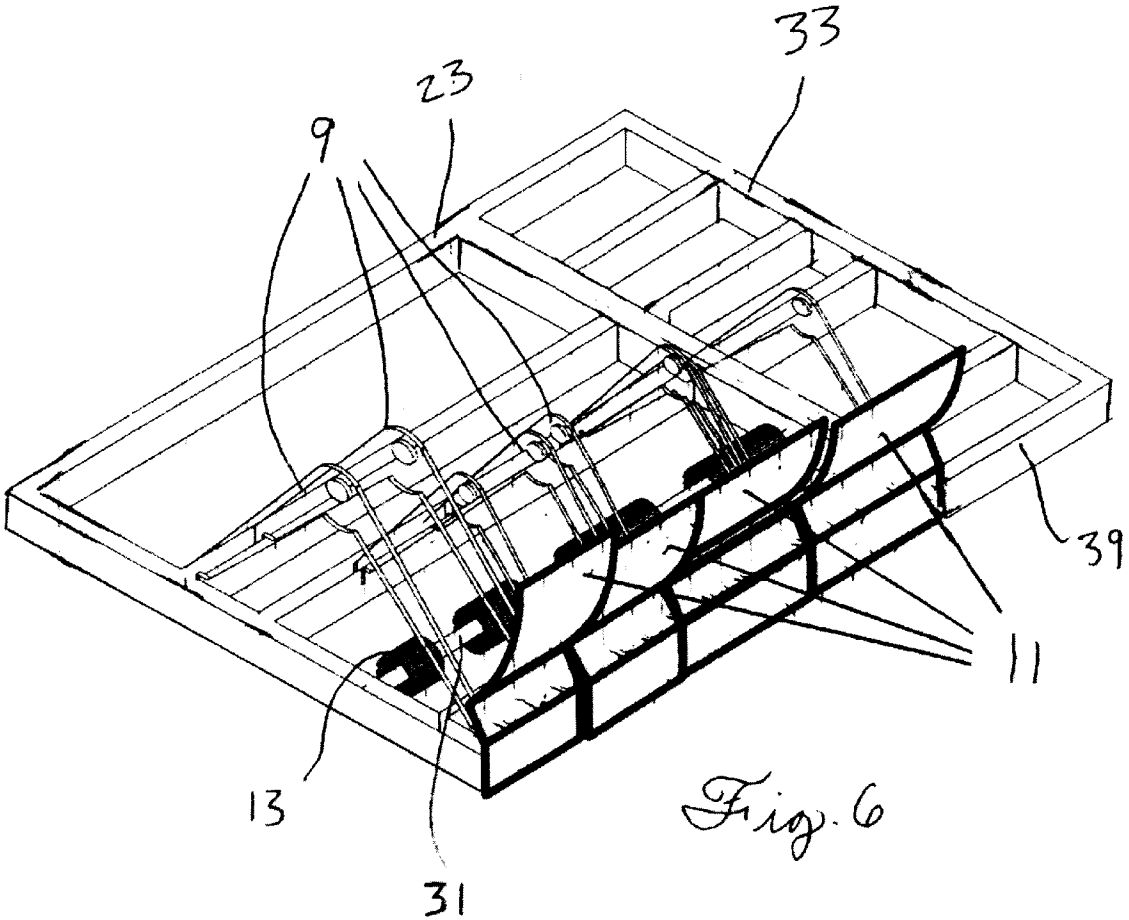
FIG. 6 is a perspective view of the framework of a storage shelf according to the present invention clearly showing the shield elements.

FIG. 6 depicts a perspective view of the framework of a storage shelf according to the present invention clearly showing the shield elements 11 whose function is to guard the tiltable cradles from damage caused by impacts associated with normal use of a storage shelf of the invention. These shields are preferably comprised of a curved piece of high impact thermoplastic, such as polypropylene or PVC, which are attached to the fourth frame member 39 using conventional means such as screws. According to an alternate form of the invention, the shield elements 11 are made of metal, and are welded to the fourth frame member 39 when the frame element is of a metallic construction.

Figure 7:
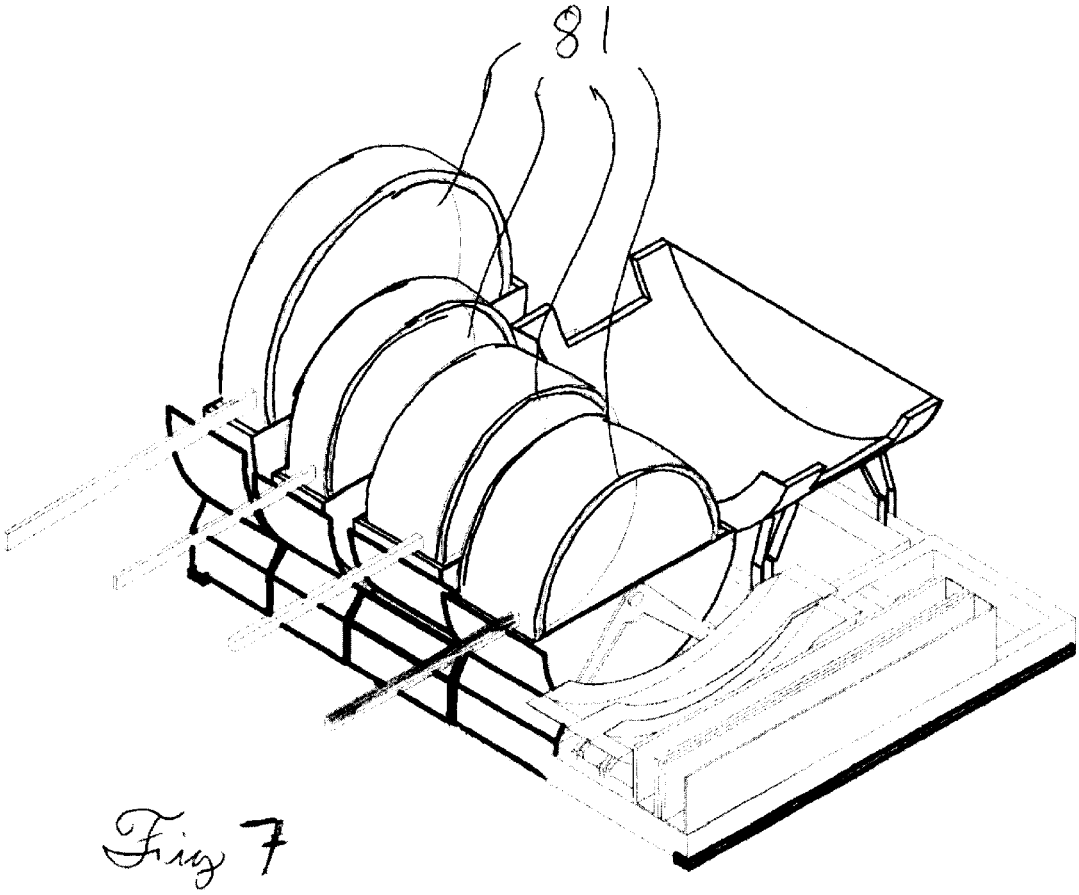
FIG. 7 is a perspective view of a storage shelf according to the present invention in its stowed position.

FIG. 7 is a perspective view of a storage shelf according to FIG. 1 of the present invention in its stowed position.

Figure 8:
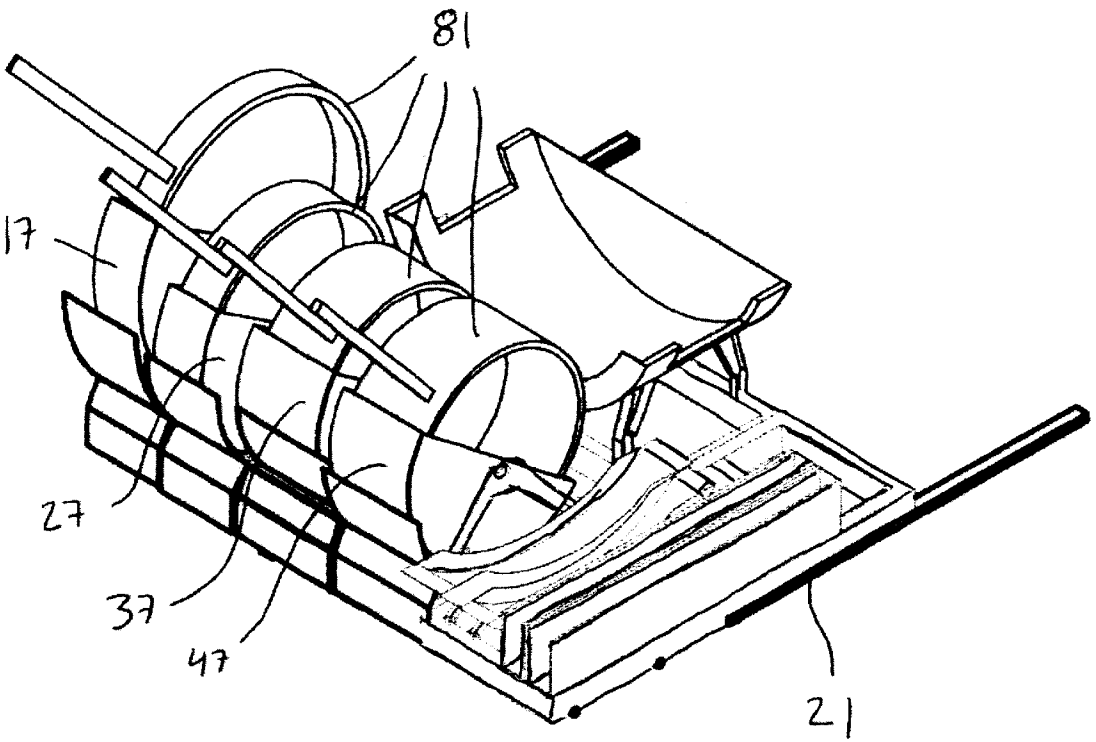
FIG. 8 is a perspective view of a storage shelf according to the present invention in its extended position.

FIG. 8 is a perspective view of a storage shelf according to FIG. 1 of the present invention in its extended position, that is, when it has been pulled out on its track from the cabinet in which it is stored, showing the tilting of the cradle means 17, 27, 37, and 47 and their contents, which in the present depictment are pots and pans, effected by virtue of the storage shelf of the invention having been pulled out in a direction indicated by R.

Thus it has been seen that the present invention provides a storage means for storing various implements which comprises a substantially planar framework comprising an interior volume, a top surface, and a bottom surface. The framework comprises a plurality of frame members each having an outer surface, and a portion of the outer surface of each of said frame members is disposed within said interior volume. In one embodiment, the frame members collectively define the perimeter of the framework. There is a linear support axle disposed within the interior volume of the framework, which support axle comprises a first end portion and a second end portion. The first end portion of the linear support axle is connected to one of the frame members of the planar framework at a point disposed within the interior volume, and the second end portion of the linear support axle is connected to one of the frame members of the planar framework at a point disposed within the interior volume. There is at least one contact roller disposed about the linear support axle. The are a plurality of cradle support arms affixed to the framework, wherein the cradle support arms include a pivot boss. The invention further comprises at least one tiltable cradle, which comprises a circumferential exterior surface and an axis point. The axis point of the tiltable cradle is pivotally disposed about the pivot point boss, and the circumferential exterior surface is in contact with the at least one contact roller.

Consideration must be given to the fact that although this invention has been described and disclosed in relation to certain preferred embodiments, obvious equivalent modifications and alterations thereof will become apparent to one of ordinary skill in this art upon reading and understanding this specification and the claims appended hereto. Accordingly, the presently disclosed invention is intended to cover all such modifications and alterations, and is limited only by the scope of the claims which follow.

I claim:

1. A storage means for storing various implements which comprises:

a) a substantially planar framework comprising an interior volume, a top surface, and a bottom surface, said framework comprising a plurality of frame members each having an outer surface, wherein a portion of the outer surface of each of said frame members is disposed within said interior volume;

b) a linear support axle disposed within said interior volume of said framework, said support axle comprising a first end portion and a second end portion, wherein said first end portion of said linear support axle is attached to one of said frame members of said planar framework at a point disposed within said interior volume, and wherein said second end portion of said linear support axle is attached to one of said frame members of said planar framework at a point disposed within said interior volume;

c) at least one contact roller disposed about said linear support axle;

d) a plurality of cradle support arms affixed to said framework, wherein said cradle support arms include a pivot point boss;

e) at least one tiltable cradle, said tiltable cradle comprising an interior volume, a circumferential exterior surface and an axis point, wherein said axis point of said tiltable cradle is pivotally disposed about said pivot point boss, and wherein said circumferential exterior surface is in contact with said at least one contact roller.

2. A storage means according to claim 1 further comprising a slidable track means affixed to the bottom surface of said substantially linear framework.

3. A storage means according to claim 2 further comprising a planar support surface, wherein said slidable track means is further affixed to said planar support surface.

4. A storage means according to claim 3, wherein said planar support surface is disposed within a closed cabinet.

5. A storage means according to claim 1 wherein said at least one contact roller is rotably disposed about said linear support axle.

6. A storage means according to claim 1 wherein said linear support axle is rotably disposed within the interior volume of said framework by means of bearings disposed at its first and second end portions.

7. A storage means according to claim 1 wherein said framework exists in the shape of a polygon selected from the group consisting of: square-shaped and rectangularly shaped.

8. A storage means according to claim 1 further comprising at least one storage tray disposed at the top surface of said framework.

9. A storage means according to claim 1 further comprising a stationary cradle disposed at the top surface of said framework.

10. A storage means according to claim 1 further comprising a ware selected from the group consisting of: pots and pans disposed within said at least one tiltable cradle.

11. A storage means according to claim 1 wherein said at least one contact roller comprises a foamed polymer selected from the group consisting of: foamed polyurethane, foamed polyethylene, and foamed polypropylene.

12. Storage means according to claim 1 wherein said at least one contact roller comprises rubber.

* * * * *